United States Patent [19]

Schossow

[11] 4,241,874

[45] Dec. 30, 1980

[54] HEAT EXCHANGER

[76] Inventor: George W. Schossow, 2316 Lilac La., White Bear Lake, Minn. 55110

[21] Appl. No.: 35,325

[22] Filed: May 2, 1979

Related U.S. Application Data

[63] Continuation-in-part of Ser. No. 798,567, May 19, 1977, Pat. No. 4,171,089.

[51] Int. Cl.[3] ..... F24B 7/04

[52] U.S. Cl. ..... 237/55; 126/112; 126/117; 165/DIG. 2; 165/104 R

[58] Field of Search ..... 165/140, DIG. 2, 104 R, 165/106; 237/55; 126/112, 117; 122/20 B

[56] References Cited

U.S. PATENT DOCUMENTS

| | | | |
|---|---|---|---|
| 1,953,302 | 4/1934 | Johnston | 165/DIG. 2 |
| 1,986,533 | 1/1935 | Schimke | 126/110 |
| 2,276,400 | 3/1942 | Hubbard | 126/110 |
| 2,343,542 | 3/1944 | Faunce | 165/DIG. 2 |
| 2,751,900 | 6/1956 | Modine | 126/110 |
| 2,882,023 | 4/1959 | Rizzo | 165/DIG. 2 |
| 2,890,866 | 6/1959 | Hansen | 165/DIG. 2 |
| 2,902,265 | 9/1959 | Dubovick | 165/DIG. 2 |
| 3,120,225 | 2/1964 | Stark et al. | 165/DIG. 2 |
| 3,147,084 | 9/1964 | Franzen et al. | 23/288 |
| 3,813,039 | 5/1974 | Wells | 237/55 |
| 3,934,572 | 1/1976 | Teague, Jr. | 126/92 B |
| 3,934,798 | 1/1976 | Goldsmith | 237/55 |
| 3,944,136 | 3/1976 | Huie | 237/55 |
| 4,034,803 | 7/1977 | Reed et al. | 165/103 |

*Primary Examiner*—Albert J. Makay
*Assistant Examiner*—William E. Tapolcai, Jr.
*Attorney, Agent, or Firm*—Merchant, Gould, Smith, Edell, Welter & Schmidt

[57] ABSTRACT

An improved heat exchanger (74) for use with a heating furnace (72) is disclosed. The exchanger (74) includes a first plurality of tubes (84) which conduct hot exhaust gases from the furnace (72). Tubes (98) carrying outside air for combustion in the furnace (72) pass proximate the first group of tubes (84) within a heat exchange chamber (90) wherein heat is transferred to the combustion air via a heat transfer medium. Similarly, ambient air in the building passes through the heat exchange chamber (90) of the exchanger (74) through a third plurality of tubes (118). These tubes (118) also pass proximate the tubes (84) carrying hot exhaust gases. In a preferred embodiment, a conduit (80), through which the exhaust gases transit from the furnace (72) to the first plurality of tubes (84) in the heat exchanger (74), can be routed through plenums (110, 126) through which combustion air and ambient air circulate after exiting the second and third pluralities of tubes (98, 118).

18 Claims, 7 Drawing Figures

HEAT EXCHANGER

CROSS-REFERENCE TO RELATED APPLICATION

This application is a continuation-in-part of applicant's copending application Ser. No. 798,567, filed May 19, 1977, now U.S. Pat. No. 4,171,089.

TECHNICAL FIELD

This invention relates generally to the field of heat exchangers used in combination with power plants, and commercial and residential heating systems. More particularly, this invention relates to the field of heat exchangers for use in home heating systems which draw cold air from outside the home for combustion.

BACKGROUND OF PRIOR ART

Home heating systems which utilize air from outside the home for combustion purposes offer significant advantages over conventional home heating systems, which draw combustion air from inside the home. Among these advantages are: (1) fuel savings due to the fact that heated room air is not being expelled up the chimney to be replaced by cold air seeping into the home; and (2) the elimination of the need for a humidifier to keep room air at a livable humidity level.

Because such systems draw cold air into their burner units rather than drawing air that has already been heated, the firebox temperature of such systems may be slightly lower than that of conventional systems. Additionally, as the stack gases proceed up the chimney, moisture contained in those gases condenses on the inside of the chimney, where it may cause chimney freeze up. Finally, the hot combustion gases being exhausted up the chimney represent wasted heat, which could be used for further room heating.

It is known in conventional furnace systems to utilize the hot stack gases for room heating by diverting the stack gases through a heat exchanger which distributes some of the heat from the flue gases to inside air. One such system is disclosed in U.S. Pat. No. 3,813,039. Heretofore, however, there has not been a furnace system which not only utilized the heat from flue exhaust gases to heat up air circulating within the home, but also was adapted to draw cold air from outside the home for combustion purposes, raise the temperature of that air slightly so as to increase the temperature of the firebox, and decrease the temperature and moisture content of the flue gases.

In the past, industrial combustion systems, such as coal-burning power plants, have utilized cyclone separators, electrostatic precipitators, and wet scrubbers to clean the stack gases of fly ash and pollutants. One of the problem pollutants has been sulphur, which is exhausted to atmosphere as sulphur dioxide. Power plants and commercial boilers thus utilize expensive, extremely tall chimney stacks to exhaust noxious gases well away from residential levels. Until the present invention, a system has not been known which satisfactorily scrubs the pollutants from the stack gases, eliminating the need for very high chimneys, and retrieves heat energy for subsequent work.

BRIEF SUMMARY OF THE INVENTION

The present invention is an improved heat exchanger which can be used in combination with furnace systems. It is particularly adaptable to be used in conjunction with home furnaces. Exhaust gases from the furnace are cooled as they pass through the exchanger, and moisture and other impurities can be removed from the exhaust by the exchanger prior to venting from the building in which the furnace is housed.

Additionally, outside air which is used for combustion in the burner of the furnace can be warmed by the exchanger prior to its being introduced into the burner chamber. Similarly, ambient air in the vicinity of the exchanger can be pre-warmed by passing it through the exchanger prior to recirculating it through the furnace.

The improved heat exchanger includes a cabinet or housing. A first plurality of tubes extends through this cabinet. Exhaust gases from the furnace are introduced into a first end of each tube comprising this plurality. The exhaust is, thereafter, permitted to pass through the tubes and is vented to the outside.

A second group of tubes also extends through the cabinet. Outside air is admitted to first ends of these tubes and exits from the second ends. This outside air then is conveyed to the furnace burner for combustion. Each of a third group of tubes which passes through the cabinet is open at its first end to ambient air within the space in which the exchanger is located. This ambient air passes through the third group of tubes and is then joined into the air circulation system of the furnace prior to being reheated and recirculated throughout the building in which the furnace is located.

The cabinet is filled with a heat transfer medium, and that medium surrounds portions of all of the tubes which extend within the cabinet. The medium serves to conduct heat from the hot exhaust gases passing through the first plurality of tubes to the combustion air and recirculation air which pass through the second and third groups of tubes respectively. In the preferred embodiment, the heat transfer medium is a liquid, and it has been found that ordinary tap water can effectively function as the medium.

In the preferred embodiment, the exhaust gases from the furnace can be introduced into the first plurality of tubes by way of a conduit interconnecting the furnace exhaust system and said first tubes. Existence of this conduit affords an opportunity to further heat the outside air for combustion and the ambient air. After exiting the tubes by which they pass through the heat exchanger, they can be made to pass through first and second outlet plenums respectively. A second stage of heating can be accomplished if the exhaust conduit is run through these plenums.

The heat exchanger of the present invention increases both the efficiency of a furnace with which it is used and also increases the efficiency of the entire heating system. In most home heating furnaces, a significant portion of the heat generated by the furnace is lost as exhaust gas exiting up a chimney. The use of the heat exchanger recovers most of this heat so that the exhaust gases exit up the chimney at a relatively low temperature. As will be illustrated in the detailed description, the heat exchanger returns the extracted heat back into the home and the furnace.

Normal flue gases contain a certain amount of steam. The heat exchanger of the present invention condenses the steam vapor out as a liquid. Thermal energy is thus gained by the heat exchanger by this process.

In conventional heating systems an after draft exists after the fuel burning process has been stopped. This after draft exists because the chimney has been heated by hot exhausts during the burning process. By utilization of the heat exchanger of the present invention, the chimney is kept cool and, hence, the after draft is reduced. A further gain in the efficiency of the system is thus attained.

In some heating systems, a barometric regulator is provided to cool a chimney should the chimney become too hot. The barometric regulator permits house air to enter the chimney to cool it. Again, by utilizing the heat exchanger of the present invention, the chimney is kept cool and, hence, the barometric regulator would not operate or would not be needed. A further gain in efficiency is thus attained.

The invention of this application thus is an improved heat exchanger for use with heating furnaces. The specific advantages of the invention will become apparent with reference to the accompanying drawings, detailed description of the invention, and claims.

DETAILED DESCRIPTION OF THE INVENTION

Figure 1:
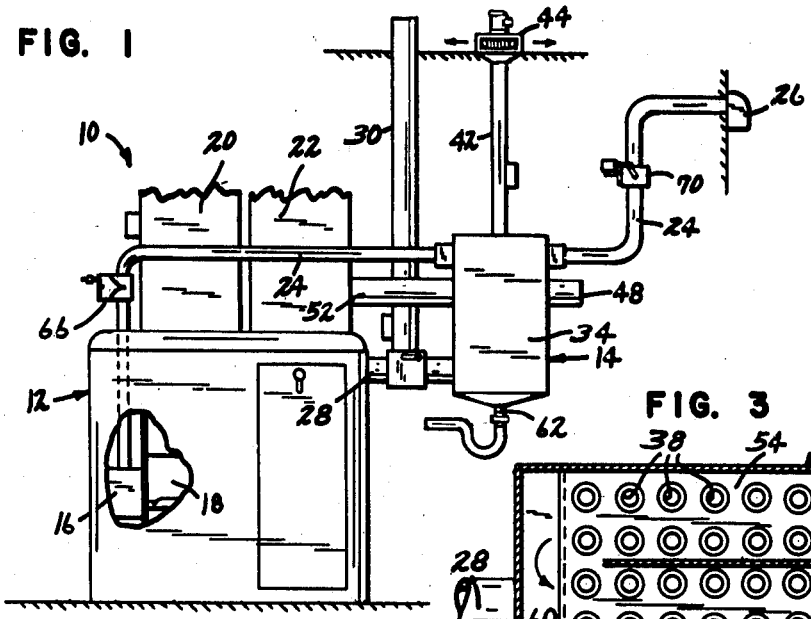
FIG. 1 is a view in side elevation, with portions thereof broken away, showing a furnace/heat exchanger combination.

Referring first to FIG. 1, there is disclosed a furnace/heat exchanger combination, generally designated by the numeral 10, in which a furnace 12 is coupled with a heat exchanger 14 constructed in accordance with the present invention. Furance 12 comprises a burner unit 16, including a blower or fan (not shown) which draws air to be mixed with the fuel for combustion. A flame burns in firebox 18 to heat air which is subsequently distributed through the home via duct 20, and which is returned to the furnace for reheating via duct or plenum 22.

Burner unit 16 draws combustion air from outside the home via conduit 24, which extends from burner unit 16 to vent 26, which is located outside the home. The gaseous products of combustion are exhausted from furnace 12 via exhaust conduit 28, and may be selectively exhausted up chimney stack 30 or routed through heat exchanger 14. A bypass gate 32 is used to select which route exhaust gases will take.

Figure 2:
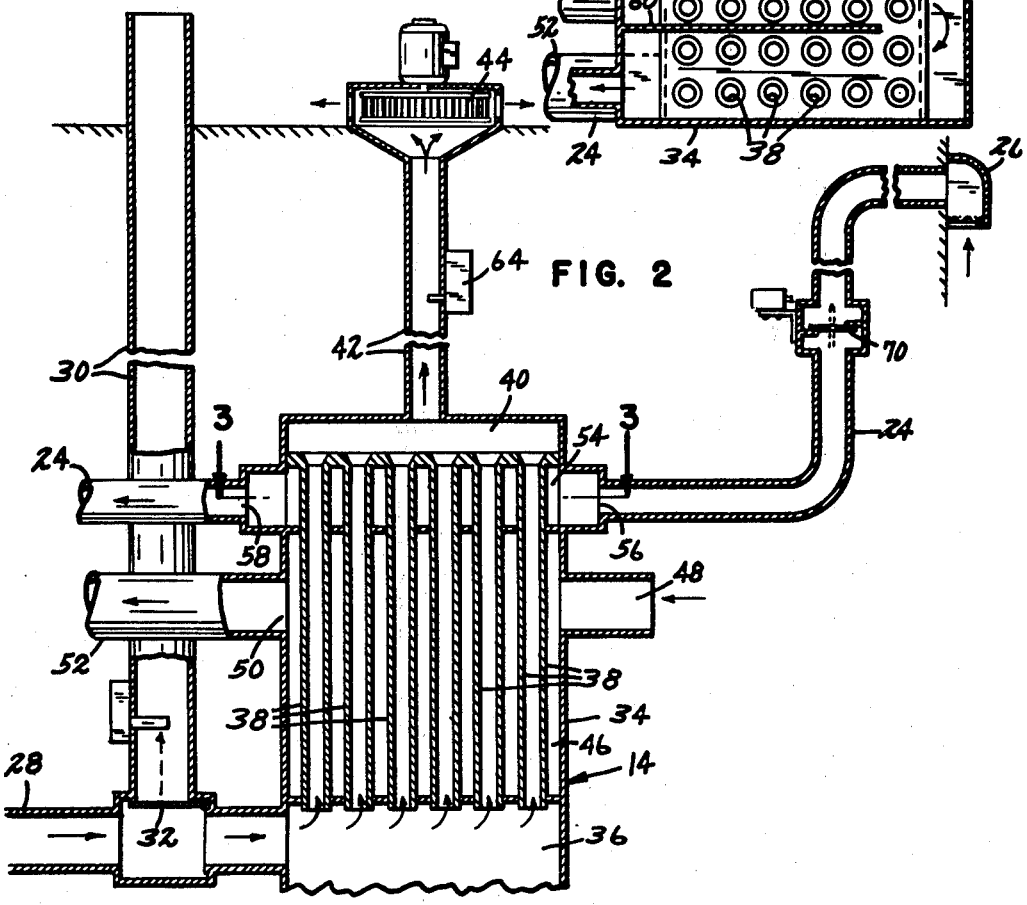
FIG. 2 is an enlarged view in section of a portion of FIG. 1, with portions thereof broken away.
Figure 4:
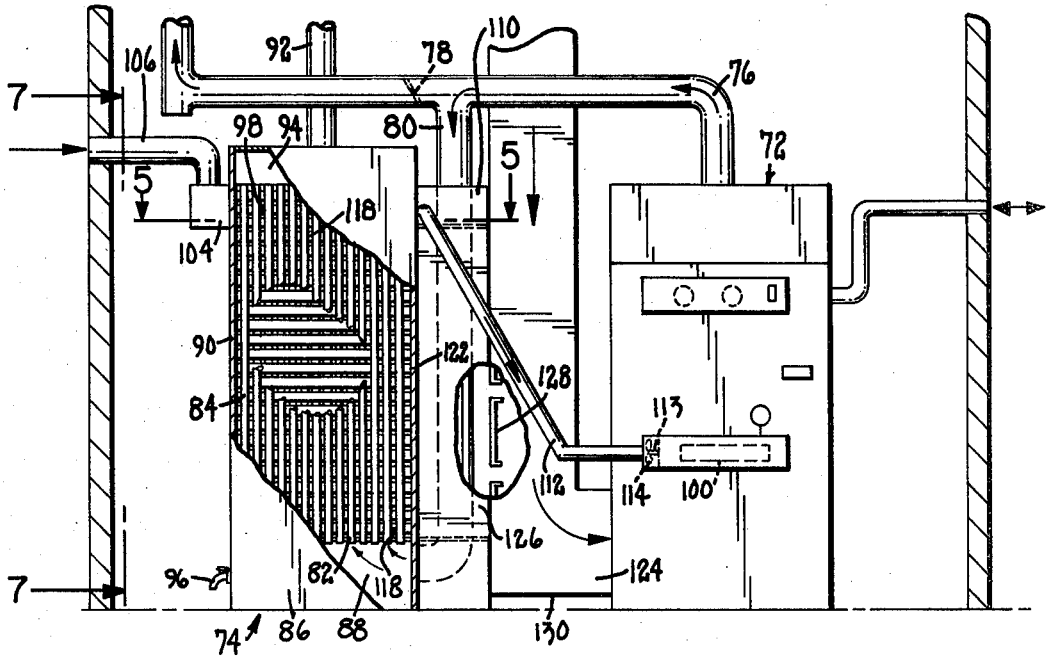
FIG. 4 is a view in side elevation, with portions broken away, showing a heat exchanger in accordance with the present invention in combination with a heating furnace.
Figure 5:
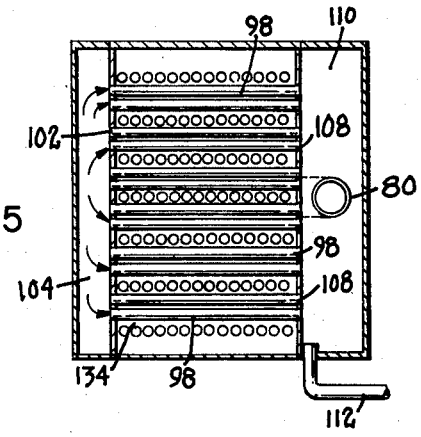
FIG. 5 is a view in section taken along the line 5—5 of FIG. 4, and indicating combustion air flow.
Figure 6:
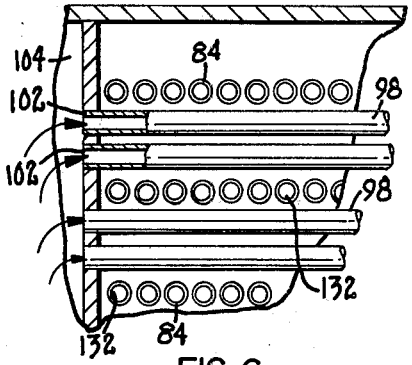
FIG. 6 is an enlarged view of a portion of FIG. 5, some portions broken away.
Figure 7:
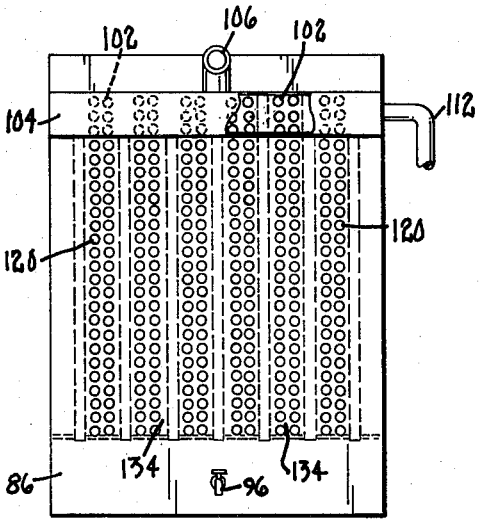
FIG. 7 is a front view of the present invention with portions thereof broken away.

Exhaust gases enter heat exchanger 14 when gate 32 closes chimney 30, as clearly shown in FIG. 2. Heat exchanger 14 comprises an outer wall 34 which encloses four chambers. The lowermost chamber 36 is a plenum into which the gaseous products of combustion flow via exhaust conduit 28. A plurality of vertically oriented tubes 38 are in fluid communication with lower chamber 36. Heat exchanger tubes 38 are of a type known in the art, such as those constructed with a copper outer wall and a corrosion-resistant inner wall of ceramic or Teflon. As indicated in FIG. 2, the exhaust gases flow upwardly through tubes 38. At their upper most ends, tubes 38 are in fluid communication with chimney stack 42. Mounted in the mouth of chimney stack 42 is a driven fan 44. The action of heat exchanger 14 causes the flue gases to cool markedly before reaching chimney 42, thus reducing the volume of the flue gases by 50% to 70%, with the result that fan 44 need not be a large power consuming fan in order to create the desired negative pressure in chimney 42. Since fan 44 is mounted downstream of heat exchanger 14, a negative pressure is created within tubes 38, which induces a draft upwardly through the heat exchanger so as to draw the exhaust gases through exhaust conduit 28, into lower chamber 36, through tubes 38 into chamber 40, and upwardly through chimney 42, and thus out of the house.

There are two intermediate chambers in heat exchanger 14. The lowermost of these chambers 46 has an upstream inlet 48, which is open to room air. Chamber 46 has a downstream outlet 50 which is in communication with the return air plenum 22 of the furnace via duct 52. The return air blower of the furnace (not shown) thus draws air from inside the home in the vicinity of the heat exchanger through chamber 46, where it circulates around tubes 38 before passing into the recirculation system of the furnace.

The uppermost intermediate chamber, indicated by the numeral 54, has upstream inlet 56 and downstream outlet 58 into which combustion air conduit 24 enters and exits.

Figure 3:
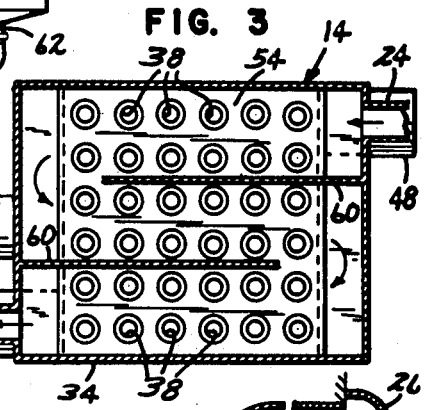
FIG. 3 is a view in section taken along the line 3—3 of FIG. 2, and indicating the flow of combustion air through the upper chamber of the heat exchanger.

Both chambers 46 and 54 are partitioned by vertically extending baffles 60, as shown in FIG. 3, so as to insure complete circulation around tubes 38 of the air entering and exiting those chambers.

Heat exchanger 14 includes a drain 62 located at its lower end to drain away the moisture which condenses and runs down tubes 38 into chamber 36.

Mounted in chimney stack 42 is a pressure sensitive switch 64 which is operably connected to burner unit 16 by means not shown, but well known in the art, and is adapted to prevent burner unit 16 from igniting, and to turn burner 16 off, if the appropriate negative pressure does not exist within chimney stack 42, i.e. if a draft up through the heat exchanger does not exist. A barometric draft regulator 66 can be mounted in a tee section of conduit 24 shown in FIG. 1, and a butterfly valve 70 which is normally open, but closes after a time delay following shut off of burner unit 16, can be included.

In operation, thermostatic control means (not shown) turn on fan 44 and open butterfly valve 70. When the appropriate draft up chimney 42 is sensed by switch 64, burner unit 16 is ignited. Cold air from outside the home is drawn into burner unit 16 via conduit 24 for combustion purposes. This cold air circulates through chamber 54 of heat exchanger 14 before passing into burner unit 16. The gaseous products of combustion are exhausted from firebox 18 via conduit 28 into lower chamber 36 of heat exchanger 14, where they are drawn up through tubes 38 and exit via chimney stack 42. The return air blower (not shown) of furnace 12 draws air from inside the home in through chamber 46 of heat exchanger 14 before entering the recirculation system of furnace 12. As the hot stack gases pass upwardly through tubes 38, cool inside air circulates around their lower portions where it picks up heat from them. At this point, the slightly acidic moisture carried within the exhaust gases condenses on the walls of tubes 38 and is drawn by gravity downwardly into chamber 36 and carried away via drain 62. This action of the moisture keeps tubes 38 clean. The cold combustion air travelling through conduit 24 is heated as it passes through chamber 54 and thus passes into burner unit 16 in a warmed state.

Referring now to FIGS. 4–7, a furnace 72 is shown in combination with a second embodiment of the heat exchanger 74 of the present invention. The furnace may be of the same type as previously discussed herein.

Gaseous products of combustion in the furnace 72 are exhausted from the furnace 72 by way of an exhaust conduit 76. These combustion products can either be vented outside the building directly or channeled through the heat exchanger 74. Channeling of the gases is selectively controlled by a bypass gate 78. If the gases are directed through the heat exchanger 74, the bypass gate 78 is closed so that they pass through a branch portion 80 of the exhaust conduit 76. This branch portion 80 of the exhaust conduit 76 introduces the gases from the furnace 72 at the first ends 82 of a plurality of tubes 84 mounted within a cabinet or housing 86 of the exchanger 74. Introduction may be made by allowing the exhaust products in the branch conduit 80 to fill a first chamber 88 which encloses the entrances to the first ends 82 of the plurality of tubes 84. The exhaust is, thereafter, drawn through the tubes 84, which extend through an intermediate heat exchange chamber 90, and exhausted outside the building in which the heat exchanger 74 is housed via an exchanger venting conduit 92. The draft in the tubes 84 may be created by a fan (not shown) and a chimney extension of the venting conduit 92, as shown at 42 in FIG. 1, can be provided by which actual venting occurs. Confluence of the gases after exiting individual tubes 84 may occur in a second chamber 94 which can be placed in fluid communication with the venting conduit 92.

Although not essential to the invention, the best mode contemplates that the tubes 84 be straight and oriented generally vertically. Such orientation would position the tubes 84 parallel with respect to one another. In such a configuration, the first chamber 88 and first ends 82 of the tubes 84 would be positioned at the lower end in order that the natural tendency of the hot gases to rise would facilitate venting.

Means can be incorporated for draining moisture of condensation, which may form in a manner hereinafter described, from the tubes 84. The means may comprise a spiggot 96 mounted externally on the first chamber 88 for controlling fluid flow from inside the chamber 88.

The exhaust gases will thus provide a source of heat to be transferred within the exchanger 74. Both oxygen-rich cool air for combustion drawn from external to the building in which the exchanger 74 is housed and ambient air inside the building will receive this heat provided by the exhaust gases. A second plurality of tubes 98 extends through the intermediate chamber 90 positioned between the first and second chambers 88, 94 heretofore described. This second plurality 98 is provided to channel outside air through the exchanger 74 prior to its being conveyed to the furnace burner 100. First ends 102 of this second plurality of tubes 98 are in fluid communication with outside air as through an inlet plenum 104 and means for conducting outside air into said inlet plenum 104, such as combustion air intake 106 in FIG. 4.

The combustion air is then drawn through the second plurality of tubes 98 and thence conveyed to the furnace burner 100 for combustion. Enclosing second ends 108 of this second plurality of tubes 98 may be a first outlet plenum 110 into which the combustion air exits from the tubes 98. Piping 112 connects the first outlet plenum 110 to an air inlet box 113. A burner fan 114 may be provided in the air inlet box 113 in order to insure a flow of outside combustion air to the burner 110.

A third plurality of tubes 118 pass through the intermediate chamber 90. First ends 120 of the tubes 118 open to ambient air inside the room. Ambient air passed through these tubes 118 is transmitted to the return air blower of the furnace system. By passing this ambient air through the heat exchanger 74, air having been circulated throughout the building in which the furnace is located and having become cool would be preheated by the air passing through the tubes 118 prior to being reheated by the fire box (not shown).

The ambient air can be transmitted from the second ends 112 of the third plurality of tubes 118 to the air recirculation system 124 via a second outlet plenum 126. An apertured wall 128 between the second outlet plenum 126 and the return recirculation duct 130 insures flow of ambient air through the third plurality of tubes 118. Essentially, the return recirculation duct 130 would be in fluid communication with the ambient air about the heat exchanger 74 through the third plurality of tubes 118. Forced flow through the duct 130 will have an eduction effect as it passes the apertured wall 128 and will draw the ambient air therethrough.

A heat exchange medium is provided in the intermediate chamber 90 surrounding portions of the first, second and third pluralities of tubes 84, 98, 118. Heat will be transferred through this medium from the hot exhaust gases in the first plurality of tubes 84 to the air in the second and third pluralities 98, 118. Cooling of the exhaust may cause condensation within the first plurality of tubes 84. If the first plurality of tubes 84 is oriented other than horizontally, this condensation will be made to flow down the inner walls 132 of the tubes 84 and will have a scrubbing effect thereon as previously described. The condensation will run down into the first chamber 88 and can be drained therefrom.

It will be clear to one of skill in the art that one of any number of fluids can be used as a heat conductive medium. It has been found that ordinary tap water, which is inexpensive and readily available, adequately serves this function.

In order to maximize the transfer of heat, the first plurality of tubes 84 can be arranged in parallel spaced rows. So spacing the rows will define at least one corridor 134 therebetween. The tubes comprising the second and third pluralities 98, 118 can be made to extend through these corridors 134 in order to maximize efficiency. Heat transfer can be further improved if the tubes comprising the second and third pluralities 98, 118 are oriented generally transverse to the orientation of the first plurality 84.

Warming of combustion air and ambient room air can be augmented by a second warming stage. The branch conduit 80 by which the hot exhaust gases are introduced into first ends 82 of the first plurality of tubes 84 can be extended through the first and second outlet plenums 110, 126. Passage of combustion air and ambient air about the conduit 80 in the first outlet plenum 110 and the second outlet plenum 126 respectively will cause those gases to take on even more heat.

Numerous characteristics and advantages of my invention have been set forth in the foregoing description. It will be understood, of course, that this disclosure is, in many respects, only illustrative, and changes may be made in details, particularly in matters of shape, size and arrangement of parts. The scope of the invention is defined in the language in which the appended claims are expressed.

What is claimed is:

1. A heat exchanger for use with a heating furnace, comprising:

a cabinet;

a first plurality of tubes extending through said cabinet, each of said tubes having first and second ends;

means for introducing exhaust gases from the furnace into first ends of said first plurality of tubes;

a second plurality of tubes extending through said cabinet, each of said second plurality having first and second ends, said first end of said second plurality being in fluid communication with outside air;

means for conveying outside air in said second plurality of tubes from said second ends to the furnace burner;

a third plurality of tubes extending through said cabinet, said third plurality having first ends in fluid communication with ambient air inside the home;

means for transmitting air inside said third plurality of tubes from second ends thereof to the return air blower of the furnace; and heat transfer medium in said cabinet surrounding portions of said first, second, and third pluralities of tubes disposed within said cabinet.

2. The heat exchanger of claim 1 wherein said conveying means includes a first outlet plenum and said transmitting means includes a second outlet plenum.

3. The heat exchanger of claim 2 wherein said means for introducing exhaust gases from the furnace into said first plurality of tubes comprises a first chamber in fluid communication with first ends of said first plurality of tubes and a conduit interconnecting said chamber and the furnace.

4. The heat exchanger of claim 3 wherein said conduit passes through said first and second outlet plenums.

5. The heat exchanger of claim 1 wherein one of said first and second ends of said first plurality of tubes is elevated with respect to said other end.

6. The heat exchanger of claim 5 further comprising means proximate said lower end of said first plurality of tubes for draining moisture of condensation therefrom.

7. The heat exchanger of claim 1 further comprising a chimney in fluid communication with said second ends of said first plurality of tubes.

8. In combination with a furnace system wherein the furnace includes a burner which draws combustion air from outside the building in which the furnace is housed, a heat exchanger for cooling exhaust gases from the furnace and removing moisture therefrom before the exhaust gases are vented from the building, for warming outside combustion air before it reaches the burner, and for pre-warming cool inside air before recirculating it through the furnace, comprising:

a conduit carrying exhaust gases from the furnace;

a housing including first and second chambers and an intermediate chamber positioned between said first and second chambers, said first chamber in fluid communication with said conduit;

a first plurality of tubes having first and second ends in fluid communication with said first and second chambers respectively, said first plurality extending through said intermediate chamber;

a first outlet plenum enclosing a first portion of said conduit;

a second outlet plenum enclosing a second portion of said conduit;

an inlet plenum;

means for conducting outside air for combustion into said inlet plenum;

a second plurality of tubes extending through said intermediate chamber, said tubes having first ends in fluid communication with said inlet plenum and second ends in fluid communication with said first outlet plenum;

a third plurality of tubes extending through said intermediate chamber, said third plurality having first ends in fluid communication with ambient air inside the building in which the furnace is located and second ends in fluid communication with said second outlet plenum;

liquid medium disposed in said intermediate chamber, said medium surrounding portion of said first, second, and third pluralities of tubes extending through said intermediate chamber;

means for conveying combustion air in said first outlet plenum to the furnace burner;

means for transmitting ambient air in said second outlet plenum to the return air blower of the furnace; and means for draining moisture of condensation from said first plurality of tubes.

9. The heat exchanger of claim 8 wherein said inlet plenum and said first outlet plenum are mounted on said housing adjacent said intermediate chamber and enclose first and second ends respectively of said second plurality of tubes.

10. The heat exchanger of claim 9 wherein said second outlet plenum is mounted on said housing adjacent said intermediate chamber and encloses second ends of said third plurality of tubes.

11. The heat exchanger of claim 10 wherein said second outlet plenum is disposed beneath said first outlet plenum.

12. The heat exchanger of claim 8 wherein each of said first plurality of tubes is straight and is oriented generally vertically and parallel with respect to each other of said plurality.

13. The heat exchanger of claim 12 wherein said first plurality of tubes is arranged in parallel spaced rows.

14. The heat exchanger of claim 13 wherein spacing of said parallel rows of said first plurality of tubes defines at least one corridor extending through said intermediate chamber, and wherein said second and third pluralities of tubes extend through said corridor.

15. The heat exchanger of claim 14 wherein said tubes comprising said second and third pluralities are disposed generally transverse to said tubes comprising said first plurality.

16. The heat exchanger of claim 13 wherein said first ends of said first plurality of tubes are disposed beneath said second ends.

17. The heat exchanger of claim 16 wherein said means for draining moisture of condensation is disposed within said first chamber.

18. The heat exchanger of claim 8 wherein said liquid medium is water.

* * * * *